US007887465B2

(12) United States Patent
Uffelman

(10) Patent No.: US 7,887,465 B2
(45) Date of Patent: Feb. 15, 2011

(54) ADAPTIVE MOTION EXERCISE DEVICE WITH PLURAL CRANK ASSEMBLIES

(75) Inventor: Alexander J. Uffelman, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

(21) Appl. No.: 12/322,678

(22) Filed: Feb. 6, 2009

(65) Prior Publication Data

US 2010/0204017 A1 Aug. 12, 2010

(51) Int. Cl.
*A63B 22/04* (2006.01)

(52) U.S. Cl. ..... 482/52; 482/70

(58) Field of Classification Search ..... 482/51, 482/52, 53, 57, 62, 70, 71, 79, 80; 601/23, 601/27, 33, 34, 35, 36
See application file for complete search history.

(56) References Cited

U.S. PATENT DOCUMENTS

| | | | | |
|---|---|---|---|---|
| 5,919,118 | A | 7/1999 | Stearns et al. | 482/51 |
| 6,152,859 | A | 11/2000 | Stearns | 482/52 |
| 6,196,948 | B1 | 3/2001 | Stearns et al. | 482/52 |
| 6,277,054 | B1 | 8/2001 | Kuo | 482/51 |
| 6,361,476 | B1 | 3/2002 | Eschenbach | 482/52 |
| 6,450,925 | B1 * | 9/2002 | Kuo | 482/51 |
| 6,726,600 | B2 * | 4/2004 | Miller | 482/52 |
| 6,840,892 | B1 | 1/2005 | Wu | 482/51 |
| 7,041,036 | B1 * | 5/2006 | Kuo | 482/52 |
| 7,104,929 | B1 | 9/2006 | Eschenbach | 482/52 |
| 7,121,984 | B1 | 10/2006 | Hong | 482/52 |
| 7,377,881 | B2 | 5/2008 | Moon | 482/52 |
| 7,540,827 | B1 * | 6/2009 | Stearns et al. | 482/52 |
| 2001/0036886 | A1 | 11/2001 | Eschenbach | 482/142 |
| 2003/0027690 | A1 * | 2/2003 | Miller | 482/51 |
| 2004/0224825 | A1 | 11/2004 | Giannelli et al. | 482/52 |
| 2005/0124466 | A1 | 6/2005 | Rodgers, Jr. | 482/52 |
| 2005/0124467 | A1 | 6/2005 | Rodgers, Jr. | 482/52 |
| 2006/0199702 | A1 | 9/2006 | Eschenbach | 482/52 |
| 2006/0217234 | A1 | 9/2006 | Rodgers, Jr. | 482/52 |
| 2006/0234838 | A1 | 10/2006 | Dalebout et al. | 482/57 |
| 2007/0032348 | A1 | 2/2007 | Hong | 482/52 |
| 2007/0087906 | A1 * | 4/2007 | Rodgers, Jr. | 482/52 |
| 2007/0087907 | A1 * | 4/2007 | Rodgers, Jr. | 482/52 |
| 2007/0219061 | A1 | 9/2007 | Rodgers, Jr. | 482/52 |
| 2007/0219062 | A1 | 9/2007 | Rodgers, Jr. | 482/52 |
| 2007/0232457 | A1 | 10/2007 | Porth | 482/51 |
| 2007/0298936 | A1 | 12/2007 | Ohrt et al. | 482/52 |
| 2008/0051260 | A1 | 2/2008 | Simonson et al. | 482/52 |
| 2008/0064572 | A1 | 3/2008 | Nardone | 482/52 |

* cited by examiner

*Primary Examiner*—Loan Thanh
*Assistant Examiner*—Tam Nguyen
(74) *Attorney, Agent, or Firm*—Terence P. O'Brien; Todd A. Rathe

(57) ABSTRACT

An exercise device includes a first crank arm assembly and a second crank arm assembly supporting opposite portions of a guide. A first foot pad is coupled to the guide to reciprocate along the guide. A foot pad link has a first end portion pivotably connected to the foot pad and a second end portion pivotably supported about an axis that is movable along one of a plurality of user selectable paths, each of the plurality of user selectable paths having a different length.

22 Claims, 15 Drawing Sheets

ADAPTIVE MOTION EXERCISE DEVICE WITH PLURAL CRANK ASSEMBLIES

BACKGROUND

Most exercise devices provide a fixed predetermined exercise path of motion. Some exercise devices now provide a user-defined exercise path of motion. However, such exercise devices utilize structural elements that are cantilevered, increasing structural rigidity requirements and increasing overall weight of the exercise device.

DETAILED DESCRIPTION OF THE EXAMPLE EMBODIMENTS

Figure 1:
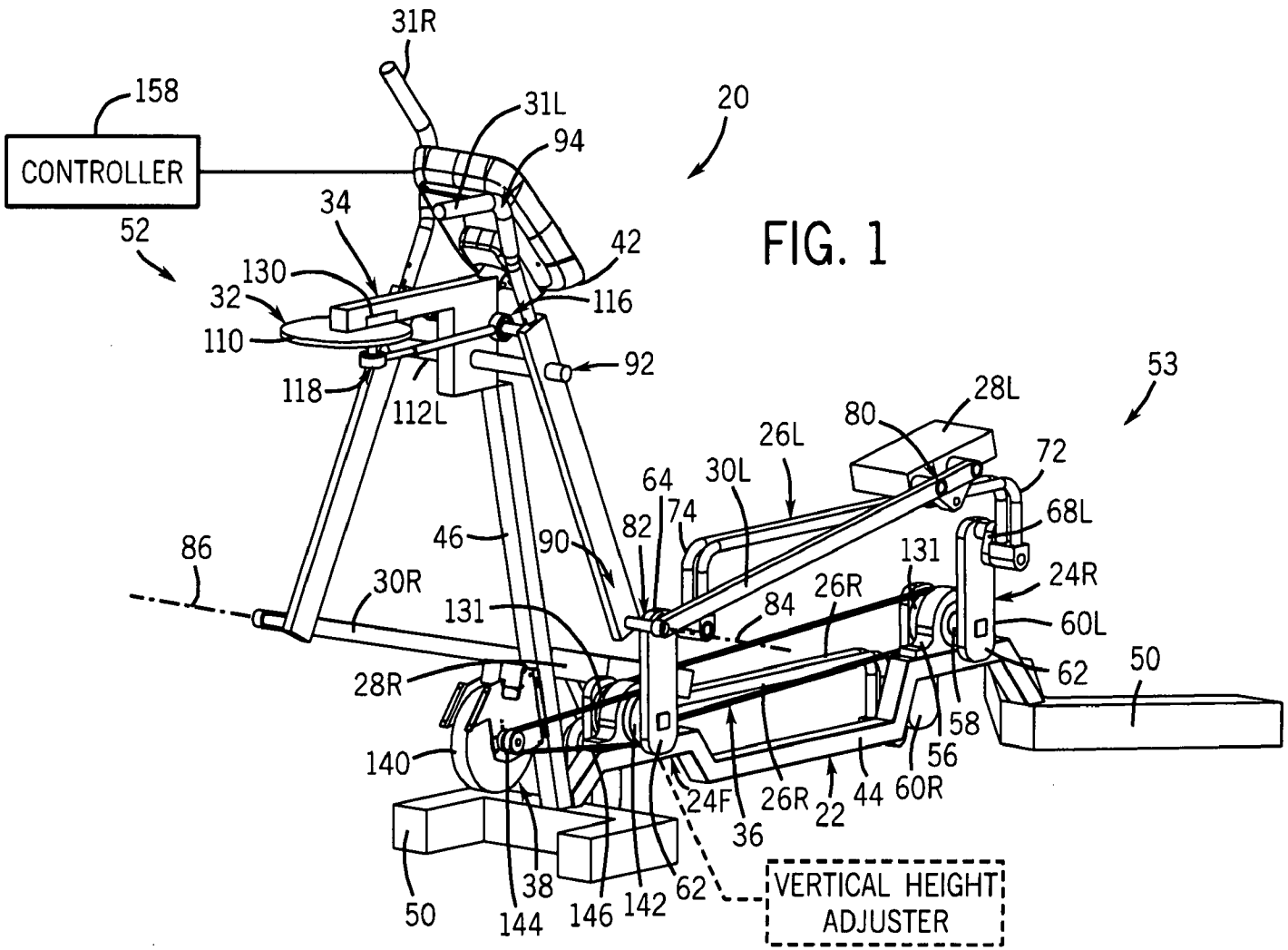
FIG. 1 is a front perspective view of a nexus size device according to an example embodiment.

FIGS. 1-4 illustrates exercise device 20 according to an example embodiment. As will be described hereafter, exercise device 20 provides a person exercising with a plurality of user selectable motion paths. The user is able to change between different available paths by simply applying different forces to foot links of the exercise device. In other words, exercised device 20 is an adaptive motion exercise device in that it automatically adapts or responds to motion of the person exercising. Exercise device 20 provides such freedom of motion with relatively few, if any, cantilevered structural elements. As a result, the structural rigidity and the overall weight of exercise device 20 may be reduced.

Exercise device 20 includes frame 22, crank assemblies 24R and 24F (collectively referred to as crank assemblies 24), guides 26R, 26L (collectively referred to as guides 26), foot pads 28R, 28L (collectively referred to as foot pad 28), foot pad links 30L and 30R (collectively referred to as foot pad links 30), swing arms 31R, 31L (collectively referred to as swing arms 31), horizontal synchronizer 32, horizontal resistance source 34, vertical synchronizer 36, vertical resistance source 34, and control panel 42. Frame 22 comprises one or more structures fastened, bonded, welded or integrally formed with one another just to form a base, foundation or main support body configured to support remaining components of exercise device 20 Frame 22 transfers load to a floor or other supporting surface. Portions of frame 22 further serve to assist in stabilizing exercise device 20 as well as to provide structures that a person may grasp when mounting and demounting exercise device 20.

As shown by FIG. 1, frame 22 includes base 44 and front upright 46. Base 44 comprises one or more structures extending along a bottom of exercise device 20 configured to support exercise device 20 upon a support surface, floor, foundation and the like. Base 44 supports crank assembly 24F proximate a front end 52 of exercise device 20 and supports crank assembly 24R proximate a rear end 53 of exercise device 20. Base 44 includes outwardly extending feet, pedestals or extensions 50 which further assist in stabilizing exercise device 20. In other embodiments, base 44 may have other configurations.

Front upright 46 comprises one or more structures providing a column, post, stanchion or the like extending upwardly from base 44 at the forward or front end 52 of exercise device 20. Upright 46 is coupled to and supports the remaining components of exercise device 20 including horizontal synchronizer 32, horizontal resistance source 34 and vertical resistance source 34. In other embodiments, upright 46 may have other configurations. In still other embodiments, upright 46 may be omitted.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Crank assemblies 24 raise and lower guides 26 in response to force applied to such guides 26 through foot pad 28. Crank assemblies 24 allow a person exercising to select an extent of vertical motion for an exercise path or routine. Crank assembly 24F is coupled to frame 22 proximate front 52 of exercise device 20 while crank assembly 24R is coupled to frame 22 proximate to rear end 53 of exercise device 20.

Figure 2:
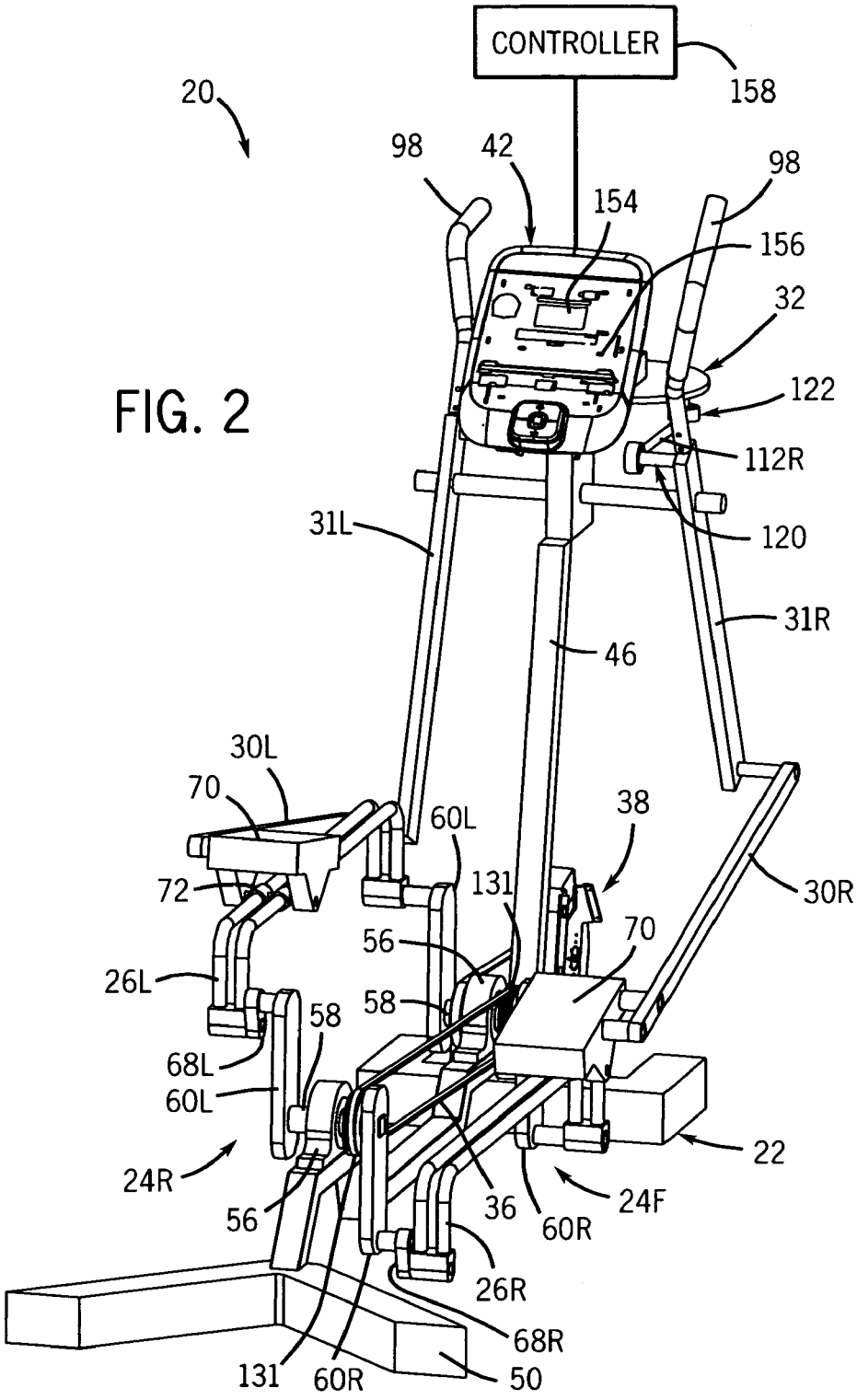
FIG. 2 is a rear perspective view of the exercise device of FIG. 1.
Figure 3:
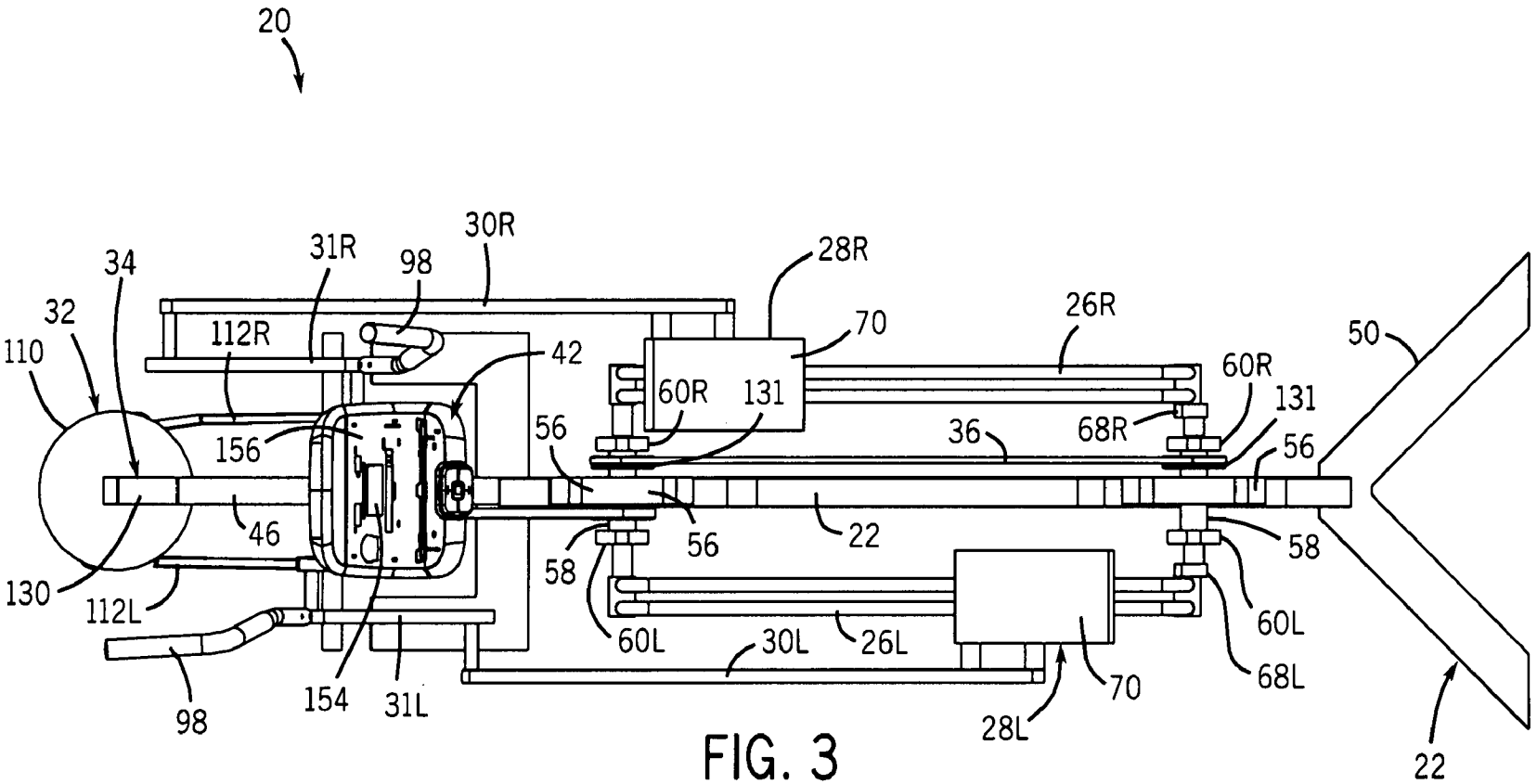
FIG. 3 is a top plan view of the exercise device of FIG. 1.

As shown by FIGS. 2 and 3, crank assembly 24F includes bearing 56, shaft 58, and crank arms 60L, 60R (collectively referred to as crank arms 60). Bearing 56 is coupled to base 44 of frame 22 and rotationally supports shaft 58. Shaft 58 extends through bearing 56 and is connected to each of crank arms 60L and 60R. Crank arms 60 comprise elongate structures, with each structure having a first portion 62 fixedly connected to shaft 58 so as to rotate with shaft 58 and a second portion 64 pivotally or rotationally connected to one of guides 26. Crank arms 60L and 60R are substantially identical to one another except that they are mounted to shaft 58 substantially 180 degrees out of phase with respect to one another. For example, when crank arm 60L extends upward from shaft 58, crank arm 60R extends downward from shaft 58.

Figure 5:
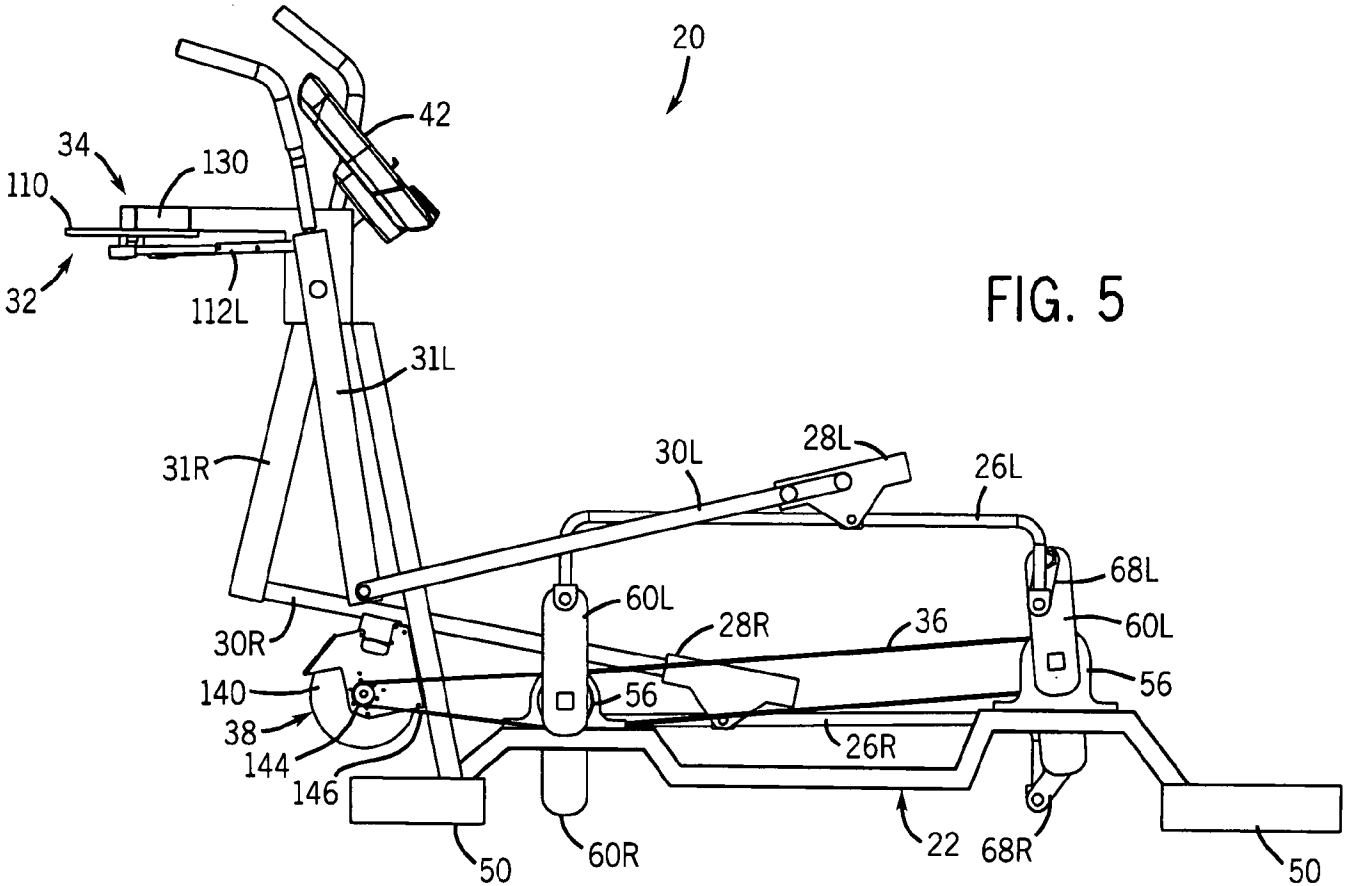
FIG. 5 is a left side elevation view of the exercise device of FIG. 1 illustrating offset provided by pivot links.

Crank assembly 24R is substantially identical to crank arm assembly 24F except that crank arm assembly 24R additionally includes pivot links 68R and 68L (collectively referred to as pivot links 68). Those remaining elements of crank assembly 24R that correspond to elements of crank assembly 24F are numbered similarly. Pivot link 68L comprises a relatively short linkage having a first end portion rotationally connected to portion 64 of crank arm 60L about a first axis and a second end portion rotationally connected to guide 26L about a second axis spaced from the first axis. Similarly, pivot link 68R comprises a relatively short linkage having a first end portion rotationally connected to portion 64 of crank arm 60R about a first axis and a second end portion rotationally connected to guide 26R about a second axis spaced from the first axis. Pivot links 68 (sometimes referred to as connecting links) allow for rotation between themselves and guides 26. As a result, pivot link 68 facilitates assembly of guides 26 to crank assemblies 24 and also eliminates or reduces binding of guides 26. In particular, each of pivot links 68 promotes forward motion of crank arms 60 and reduces or limits the occurrence of "dead zones" when crank arms 60 are at a top of the rotation (as shown in FIG. 5). Pivot links 68 further allow crank arms 60 of crank assembly 24F to rotate slightly out of phase with respect to crank arms 60 of crank assembly 24R which further reduces the occurrence of stalls or "dead zones." In other embodiments, pivot link 68 may be omitted such that crank assembly 24R is identical to crank assembly 24F in almost all respects.

In the example illustrated, crank arms 60L of crank assemblies 24R and 24F have substantially identical lengths between their pivot points. Crank arms 60R of crank assemblies 24R and 24F have substantially identical lengths between their pivot points. In other embodiments, crank arms 60L and 60R of crank assembly 24R may have different lengths as compared to crank arms 60L and 60R. of crank assembly 24F. For example, in one embodiment, crank arms 60L and 60R of crank assembly 24R may alternatively be longer than crank arms 60L and 60R of crank assembly 24F to provide for greater heel lift during reciprocation of foot pads 28. In other embodiments, crank arms 60L and 60R of crank assembly 24R may alternatively be shorter than crank arms 60L and 60R of crank assembly 24F to provide for greater elevation at the front of exercise device 20 such that a person exercising is working up an incline during reciprocation of foot pads 28.

Guides 26 comprise elongate structures configured to guide reciprocal movement of foot pad 28. Each of guides 26 has a first end portion 72 rotationally or pivotally connected to one of pivot links 68 of crank assembly 24R and a second end portion 74 are rotationally or pivotally connected to portion 64 of one of crank arms 60 of crank assembly 24F. The device further includes a vertical height actuator 69 configured to selectively raise and lower a rotational axis of the first crank arm assembly relative to a rotational axis of the second crank assembly. In the example illustrated in which crank arms 60 of crank assemblies 24R and 24F have substantially the same length (the same distance between a centerline of shaft 58 and the axis about which guide 26R, 26L pivots or rotates relative to the corresponding pivot link 68 of the crank arm 60 of crank assembly 24R or the axis about which guide 26 pivots or rotates relative to one of crank arm 60 of crank assembly 24F), guides 26 remains substantially horizontal or level while rotating about the axis of shafts 58 of crank assemblies 24R and 24F. In other embodiments where crank arms 60 of crank assembly 24R may have a different length as compared to crank arms 60 of crank assembly 24F, guides 26 may have inclined, declined or tilted orientations while rotating about the axes of shafts 58.

In the example illustrated, each of guides 26 comprises a pair of parallel rails having downwardly turned ends. As will be described in more detail hereafter, foot pad 28 at least partially surrounds such rails to slide or glide along such rails as they reciprocate along such rails. In other embodiments, each of guides 26 may alternatively comprise one or more channels, wherein the pads 28 slide, rotate or otherwise move along guided paths within the channels. In yet another embodiment, each of guides 26 may comprise a ramp along which foot pad 28 rolls. Although guides 26 are illustrated as being substantially straight or linear along a majority of their lengths, in other embodiments, guides 26 may be arcuate are curved.

Foot pads 28, also known as pedals 28, comprise structures slidably coupled to guides 26 so as to reciprocate along guides 26. Foot pads 28 provide surfaces upon which a person's feet may rest and apply force. Foot pads 28 are further configured to pivot about at least one axis substantially perpendicular to the axis along which guides 26 extend. As a result, foot pad 28 provide for a more natural moving feel during motion. In other words, foot pads 28 pivot to adjust an angle at which a person's ankles bend during a stride for enhanced feel. In other embodiments in which guides 26 themselves tilt or pivot, such as when crank arms 60 of crank arm assembly 24R have different lengths as compared to crank arm 60 of crank assembly 24F, foot pads 28 may alternatively be pivotally fixed to guides 26 so as to not pivot or rotate as they travel along guides 26.

As shown in FIG. 2, in the example illustrated, each foot pad 28 includes a platform 70 and a pair of bearing tubes 72. Platform 70 provides a surface upon which a person may place the bottom of his or her foot. Although not illustrated, in some embodiments, each foot pad 28 may be additionally provided with other structures for assisting in the retention of a person's foot upon foot pad 28 and for assisting a person in applying force to foot pad 28. For example, in other embodiments, each of platforms 70 may additionally include a toe clip or toe cup.

Bearing tubes 72 comprise tubes through which the rods or rails of guides 26 extend. Bearing tubes 72 slide along the rods or rails of guides 26 along with their associated foot pads 28. Bearing tubes 72 are, themselves, pivotally or rotationally connected to under sides of foot pads 28. As a result, foot pad 28 may slide along guides 26 relative to guides 26. In other embodiments, foot pads 28 may be movably coupled to guides 26 and may be pivotally supported in other fashions.

Foot pad links 30 comprise members connected between foot pads 28 and swing arms 31. Foot pad links 30 each have a first end portion 80 coupled to one of foot pads 28 and a second opposite end portion 82 pivotally connected to one of swing arms 31. In the example illustrated, foot pads 28 are pivotally supported on guides 26, wherein foot pad links 30 are fixedly coupled to foot pads 28. In other embodiments, foot pads 28 may alternatively be non-pivotally coupled to guides 26. In such alternative embodiments, foot pad links 30 are then alternatively pivotally connected to foot pads 28. In the example illustrated, end portion 80 of foot pad link 30L is coupled to foot pad 28L while end portion 80 of foot pad link 30R is coupled to foot pad 28R. In the example illustrated, end portion 82 of foot pad link 30L is pivotally coupled to swing arm 31L about a pivot axis 84 while end portion 82 of foot pad link 30R is pivotally coupled to swing arm 31R about a pivot axis 86. The axes 84 and 86 about which end portions 82 of the links 30 pivot are each movable along one of a plurality of user selectable paths. For example, axis 84 may be moved by user through the application of force to foot pads 28 to move foot pads 28 through different paths having different shapes and magnitudes. For example, axis 84 may be moved through a more circular path or more elliptical path. The length and height of foot pads may be varied by user. Axis 86 may likewise be moved through a multitude of different paths. These different paths provide freedom of motion for foot pads 28 and allow exercise device 20 to automatically adapt to the person exercising and movement of his or her feet as desired.

Swing arms 31 extend between end portions 82 of foot pad links 30 and upright 46 of frame 22. Each of swing arms 31 has an end portion 90 pivotally connected to end portion 82 of one of foot pad links 30, an intermediate portion 92 pivotally coupled to upright 46 and an end portion 94 configured to serve as a handgrip. Swing arms 31 allow a person to exert force upon swing arms 31 to assist in movements of foot pads 28. In other embodiments, other stationary arms or separate swing arms may be provided. In such other embodiments, end portions 94 may be omitted, wherein separate links, not serving as swing arms, have an end portion 90 pivotally connected to foot pad links 30 and another end portion 92 pivotally connected to upright 46. In other embodiments, each pair of swing arms 31 and foot pad links 30 may be replaced with a single member or assembly of fixed members fixed to one another, wherein the single member or the assembly of fixed members has one portion pivotally connected to upright 46 and another portion pivotally connected to one of foot pads 28.

Horizontal synchronizer 32 comprises a mechanism configured to synchronize horizontal or fore and aft movement of foot links relative to one another. In particular, horizontal synchronizer 32 is configured to synchronize forward and rearward movement of foot pad 28R with rearward and forward movement of foot pad 28L. In the example illustrated, synchronizer 32 includes rocker 110 and synchronizer links 112L and 112R (shown in FIG. 2). Rocker 110 comprises a structure pivotally connected to upright 46 of frame 22 for pivotal movement about an axis substantially perpendicular to the axis about which main arms 90 of swing arms 33 pivot. In the example illustrated, rocker 110 comprises a wheel or disk. In other embodiments, rocker 110 may comprise an elongate, more linear structure, arm or member.

Synchronizer link 112L comprise a linkage having a first end 116 pivotally connected to swing arm 33L on a first side of the pivot axis of rocker 110 and a second end 118 pivotally connected to rocker 110 on a second side of the pivot axis of rocker 110. As best shown in FIG. 2, synchronizer link 112R comprises a linkage having a first end 120 pivotally connected to swing arm 33R and a second end 122 pivotally connected to rocker 110 on a second side of the pivot axis of rocker 110. As a result of this construction, when foot pad 28L is moving forwardly, foot pad 28R must move rearwardly and vice versa. With this construction, foot pad synchronizer 32 utilizes structural components or linkages already provided by swing arms 31, reducing the number of parts and complexity of horizontal synchronizer 32. In other embodiments, other mechanisms may be utilized to synchronize movement of foot pads 28. For example, other mechanisms not connected to swing arms 31 may be utilized to synchronize movement of foot links 26.

Horizontal resistance source 34 comprises a source of controllable and adjustable resistance against the forward and rearward movement of foot pads 28. In the example illustrated, horizontal resistance source 34 comprises an Eddy brake system. In particular, horizontal resistance source 34 includes a magnet 130 (schematically shown) positioned opposite to a ferromagnetic or ferrous rocker 110.

Magnet 130 comprises a magnetic member configured and located so as to apply a magnetic field to rocker 110. In the example illustrated, magnet 130 extends generally opposite to a face of rocker 110. The magnetic field applied to rocker 110 by magnet 130 creates eddy currents that themselves create opposing magnetic fields that resist relative rotation or pivotal movement of rocker 110. By resisting relative rotation of rocker 110, pivotal movement of swing arms 33 and horizontal movement of foot links 26 and their associated foot pads 28 are also resisted.

In the example illustrated, rocker 110 serves as the ferromagnetic member in which Eddy currents are created. In other embodiments, a separate ferromagnetic member may be mounted to rocker 110 so as to rotate or pivot with rocker 110 relative to magnet 130. Although magnet 130 is stationarily supported by upright 46 opposite to rocker 110, in other embodiments, magnet 130 may be coupled to and carried by, rocker 110 so as to rotate in response to rocking of rocker 110, while a Separate ferromagnetic member is supported by upright 46 in a stationary manner opposite to magnet 130. Because horizontal resistance source 34 utilizes already existing components of foot pad synchronizer 32 and swing arms 31, the number of parts, the volume or space consumed by resistance source 34 and complexity are reduced. In other embodiments, horizontal resistance source 34 may have other configurations. In other embodiments, horizontal resistance source 34 may alternatively not utilize components of one or both of synchronizer 32 or swing arms 33.

In the example illustrated, the resistance applied by magnet 130 is adjustable and selectable by a person exercising. In one embodiment, magnet 130 comprises an electro-magnet, wherein electrical current transmitted through magnet 130 may be varied to adjust the magnetic field and the degree of resistance provided by source 34. In one embodiment, the electrical current transmitted to magnet 130 varies in response to electrical circuitry and control signals generated by a controller associate with control panel 42 in response to input from the person exercising or an exercise program stored in a memory associated, connected to or in communication with the controller of control panel 42.

In another embodiment, the resistance applied by magnet 130 may be adjustable by physically adjusting a spacing or gap between rocker 110 and magnet 130. For example, in one embodiment, source 30 may include an electric solenoid, a coil or other mechanical actuator configured to move one of rocker 110 or magnet 130 relative to one another so as to adjust the gap.

Vertical synchronizer 36 comprises a mechanism configured to synchronize vertical movement of guides 26 and their associated foot pads 28. In particular, vertical synchronizer 36 synchronizes such movement such that guides 26 move substantially 180 degrees out of phase with respect to one another. In particular, when guide 26L and foot pad 28L are moving upward, guide 26R and foot pad 28R are moving downward, and vice versa. In some embodiments, vertical synchronizer 36 may be configured such that rotation of crank assemblies 24R and 24F is slightly out of phase. In such an embodiment, pivot links 68 enable the out of phase relationship between crank assemblies 24R and 24F to occur while maintaining smooth reciprocation of foot pads 28. At the same time, because rotation of crank assemblies 24R and 24F is out of phase, exercise device 20 achieves greater heel lift during reciprocation of foot pads 28.

In the example illustrated, vertical synchronizer 36 synchronizes rotation of crank assemblies 24R and 24F. In the example illustrated, vertical synchronizer 36 comprises an endless member wrapped about and operably connected to shafts 58 of crank assemblies 24R and 24F. In the particular example illustrated, vertical synchronizer 36 includes a pair of toothed pulleys 131 connected to shafts 58, wherein the endless member comprises an endless timing belt. In other embodiments, vertical synchronizer 36 may comprise a pair of sprockets instead of a pair of pulleys, wherein the endless member comprises a chain. In yet another embodiment, rotation of crank assemblies 24 may be synchronized by gear trains or other synchronizing mechanisms. In some embodiments, such as embodiments where pivot links 68 have relatively short length and where crank arms 60 have substantially the same lengths such that guides 26 remain substantially parallel, synchronizer 36 may be omitted.

Vertical resistance source 38 comprises a source of controllable and adjustable resistance against the raising and lowering of foot pad links 26 and foot pads 28. In the example illustrated, vertical resistance source 38 comprises a source of controllable and adjustable resistance against rotation of one or both of crank assemblies 24. In the example illustrated, resistance source 38 comprises a generator 140 operably coupled to crank assembly 24F so as to be driven by rotation of crank assembly 140. The power produced by generator 140 generates electrical current to run or at least partially power display panel 42. In one embodiment, the generated power is stored in a battery or other storage device and is used to power display panel 42. In yet other embodiments, the generator power may be simply dissipated or used for other purposes.

In the particular example illustrated, crank assembly 24F is operably coupled to generator 140 by a belt and pulley arrangement including a pulley on 142 fixed to shaft 58 of crank assembly 24F, a pulley 144 connected to input shaft of generator 140 and an intervening immediate belt 146. In other embodiments, generator 140 may be operably coupled to crank assembly 24F by other mechanisms such as chain and sprocket arrangements, gears and the like. In still other embodiments, generator 140 may alternatively be operably coupled to crank assembly 24R.

In alternative embodiments, resistance source 38 may comprise other mechanisms. For example, in other embodiments, resistance source 38 may comprise an Eddy brake system similar to horizontal resistance source 32 described above. In other embodiments, resistance source 38 may comprise a friction brake or friction resistance source. In yet another embodiment, other resistance mechanisms may be employed.

Control panel 42 comprises a panel by which a person exercising may view current settings of exercise device 20 and may adjust the current settings of exercise device 20. Control panel 42 may additionally provide a person exercising with feedback as to his or her exercise routine, such as duration, calories burned and the like, or may provide the person exercising with instructions or objectives for an upcoming exercise routine are workout. As shown by FIG. 2, control panel 42 includes display 154, input 156 and controller 158. Display 154 comprises a display configured to present information to a person excising. Display 154 may comprise a liquid crystal display, an array of light emitting diodes or other devices for providing visual information.

Input 156 comprises one or more mechanisms by which a person exercising may enter selections are commands. Input 156 may comprise a touchpad, a touch screen, toggle switches, one or more buttons, a mouse pad, a scroll wheel, a slider bar or various other input devices. Controller 158 comprises one or more processing units connected to display 154 and input 156 as well as horizontal resistance source 34 and vertical resistance source 38. Controller 158 may also be connected to one or more sensors (not shown). Based on information received from resistance sources 34 and 38, and the one or more sensors, controller 158 may generate control signals directing display 154 provide a person exercise with feedback as to his or her exercise routine or current settings of exercise device 20.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 158 may be embodied as part of one or more application-specific integrated circuits (ASICs). Unless otherwise specifically noted, the controller is not limited to any specific combination of hardware circuitry and software, nor to any particular source for the instructions executed by the processing unit. Based upon input received from input 156, controller 158 may generate control signals adjusting the resistance applied by resistance source 30 or resistance source 38. Such changes or adjustments may alternatively be made in response to stored programs or exercise routines associated with a memory of controller 158 or received by controller 158 through wired or wireless connections. In still other embodiments, display panel 42 may be omitted.

Figure 4:
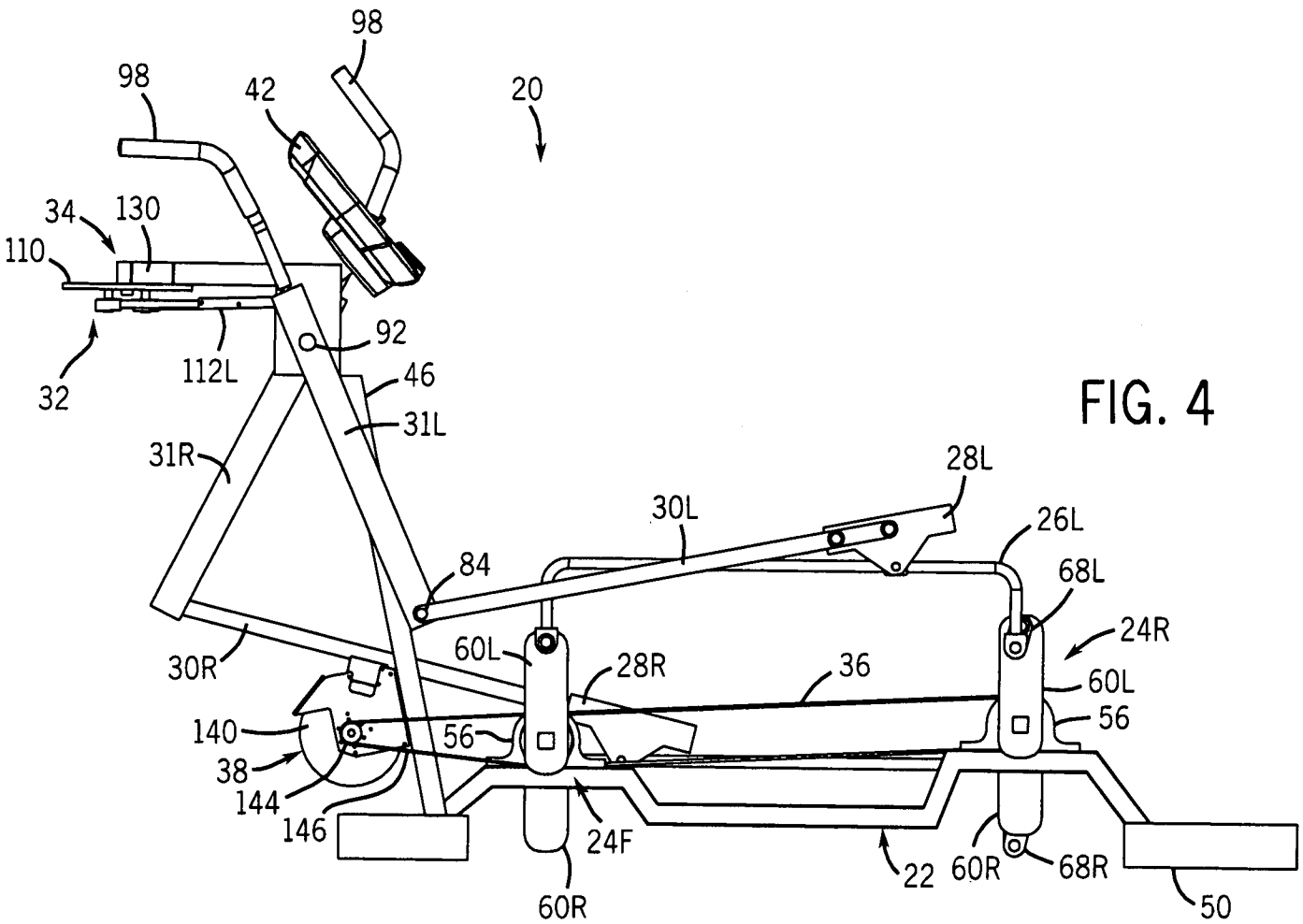
FIG. 4 is a left side elevation of view of the exercise device of FIG. 1.
Figure 6:
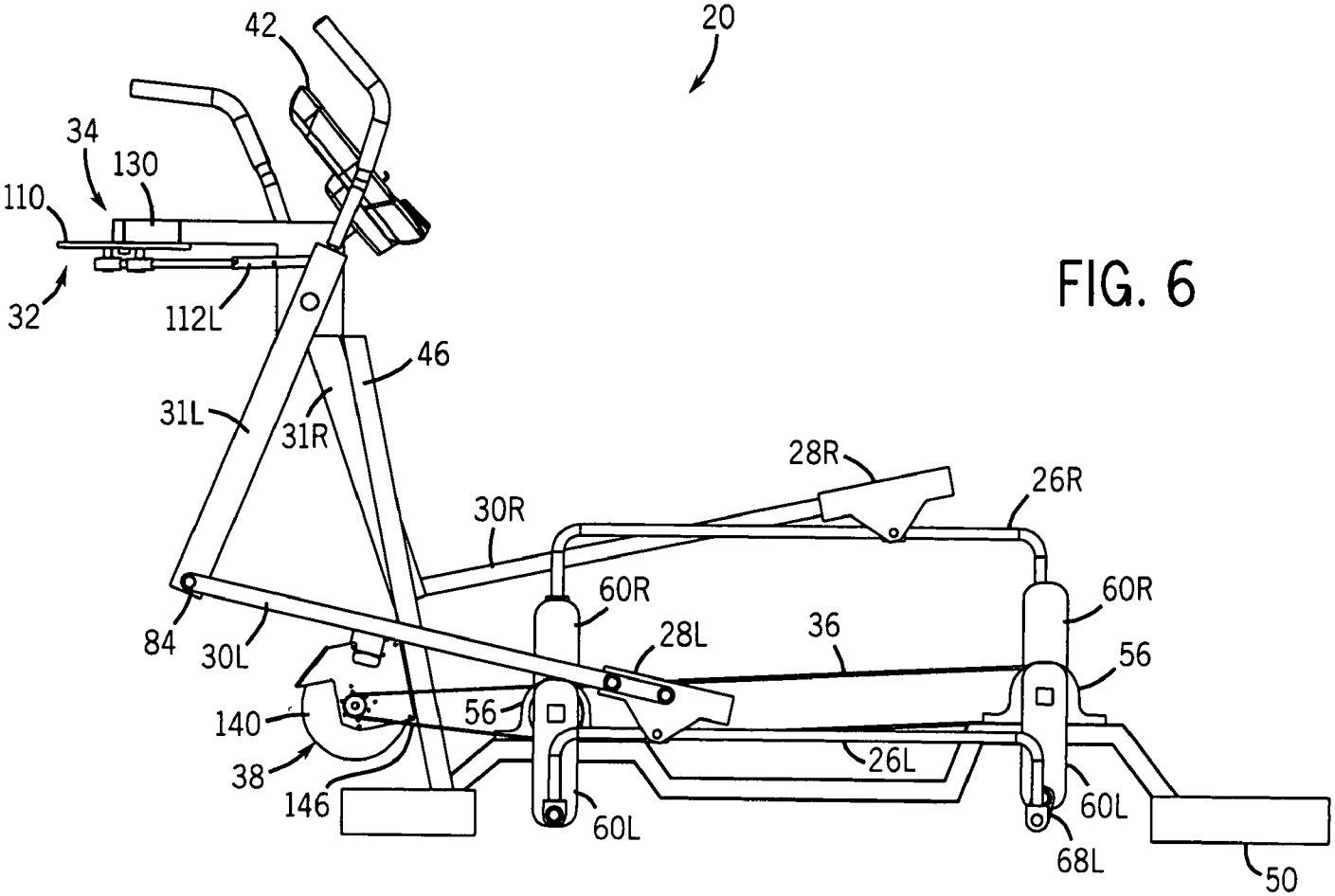
FIG. 6 is a left side elevational view of the exercise device of FIG. 4 illustrating footpads in different positions.
Figure 7:
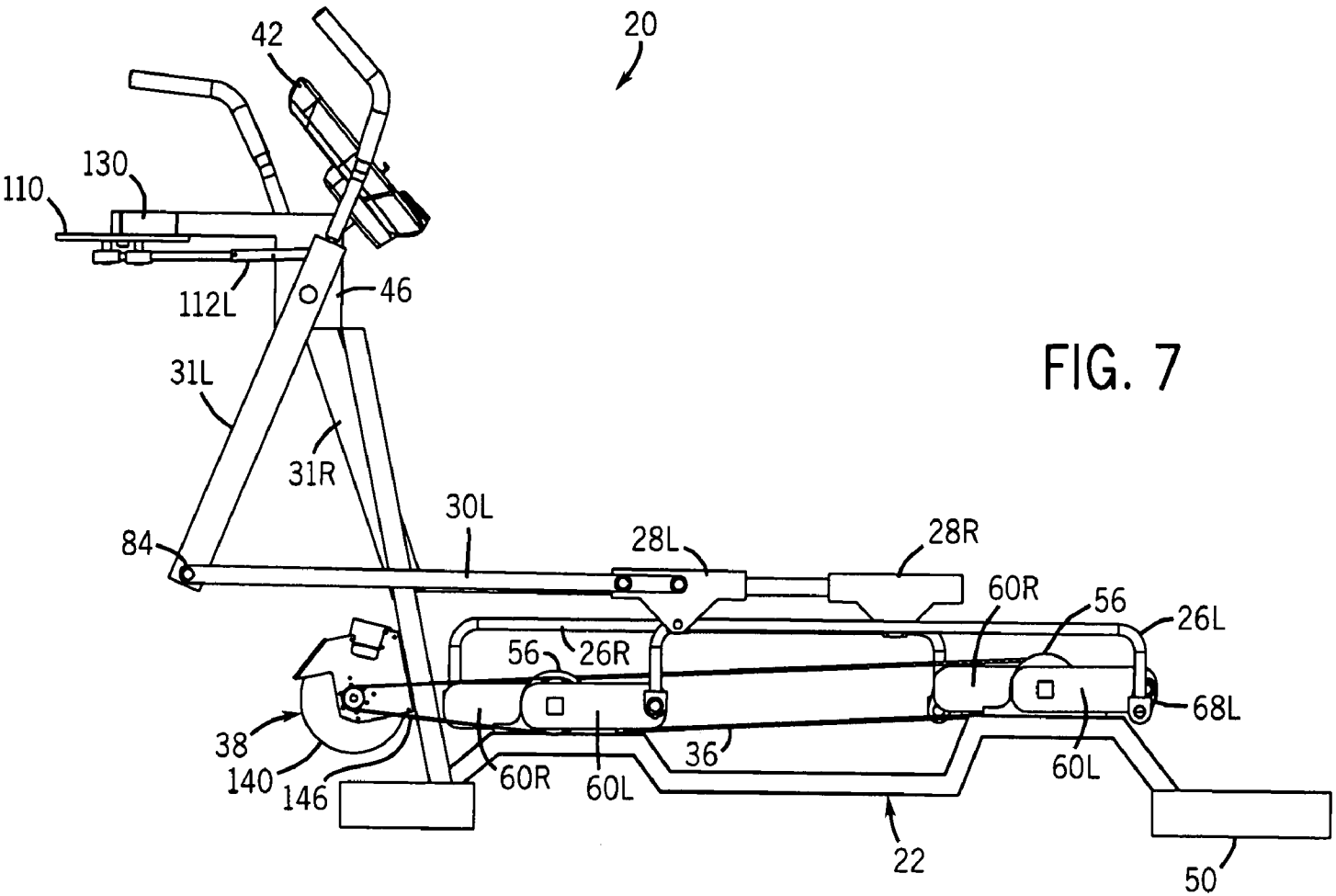
FIG. 7 is a left side elevational view of the exercise device of FIG. 4 illustrating footpads in different positions.
Figure 8:
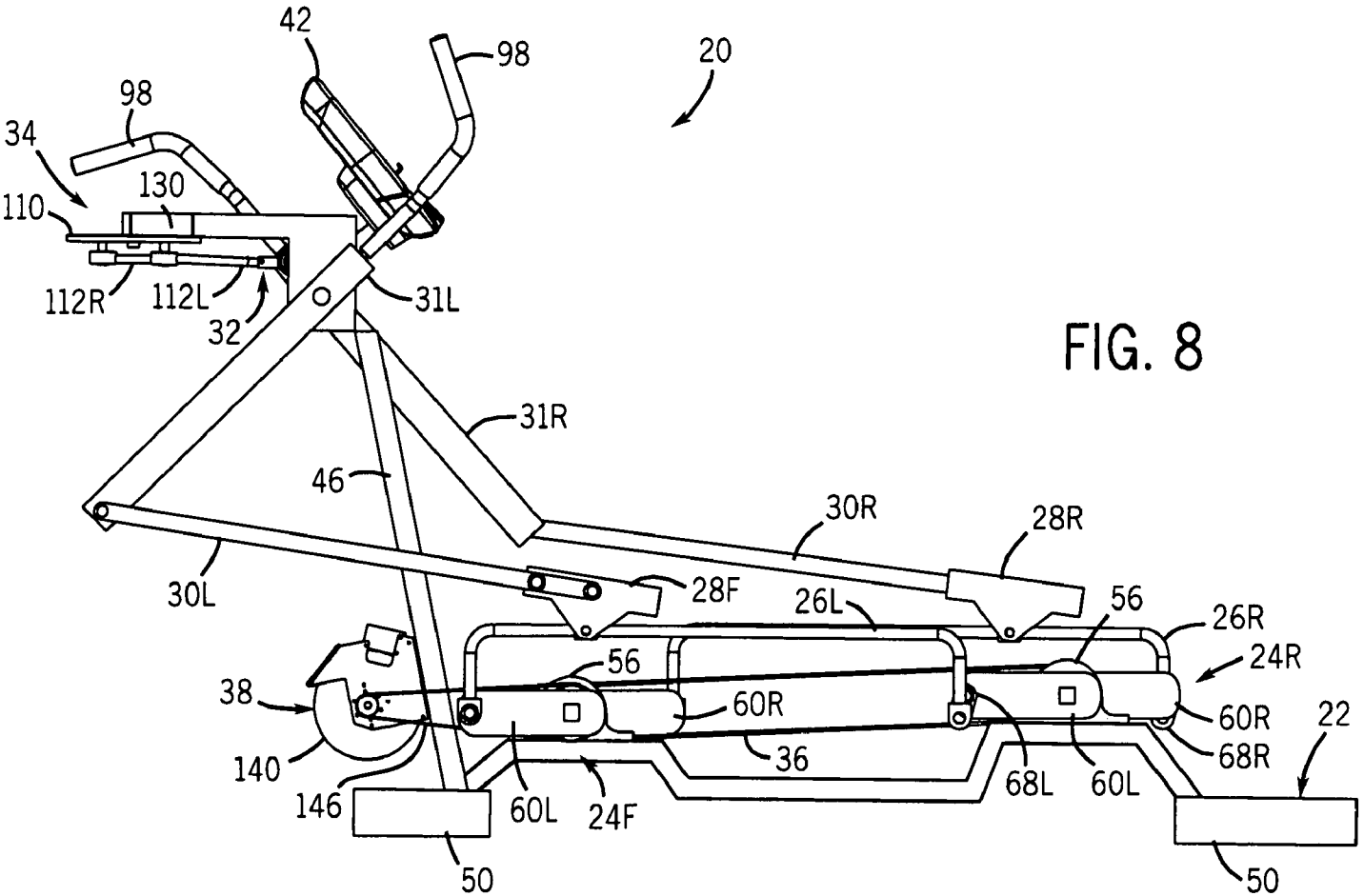
FIG. 8 is a left side elevational view of the exercise device of FIG. 4 illustrating footpads in different positions.

FIGS. 4-8 illustrate exercise device 20 with the foot pad links 26 and their associated foot pads 28 at various positions along different exercise paths of motion. FIGS. 4 and 5 illustrate foot pads 28 at different horizontal positions while at substantially the same vertical positions. FIG. 6 illustrate foot pads 28 while at substantially the same vertical and horizontal positions as compared to the state shown in FIG. 5 except that foot pad 28R and foot pad 28L are substantially 180 degrees out of phase compared to the state shown in FIG. 5 (foot pad 28 is now lower than foot pad 28R). FIGS. 7 and 8 illustrate foot pads 28 at different horizontal positions while at substantially the same vertical position. In summary, FIGS. 4-6 illustrate more elliptical motion in which foot pads 28 are moved along paths that vary in both horizontal and vertical magnitudes. FIGS. 7 and 8 illustrate foot pads 28 being moved in more of a fore and aft striding exercise path. in addition, the configuration of exercise device 20 also enables more of a stair climbing exercise path in which axes 84 and 86 (shown in FIG. 1) are substantially stationary while foot pads 28 continue to move in the largely up-and-down directions.

Overall, exercise device 20 provides a person exercising with multiple user selectable paths of motion for foot pad links 26 and foot pads 28. A particular path a motion for foot pads 28 may be adjusted by user by the user simply applying different forces or directional forces to foot pad 28 with his or her feet. Such changes in the motion paths may be made "on-the-fly" by the person excising during an exercise routine or workout without the person having to remove his or her hands from handgrips 98. Exercise devise automatically adapts to a person's motion or motion changes. Exercise device provides such freedom of motion with very few, if any, cantilevered members. For example, foot links pads 26 which support foot pads 28 are supported at opposite ends have little, if any, cantilevered portions. Exercise device 20 provides a more solid and stable feel, may be formed from less structurally rigid materials and may be lighter in overall weight.

Figure 9:
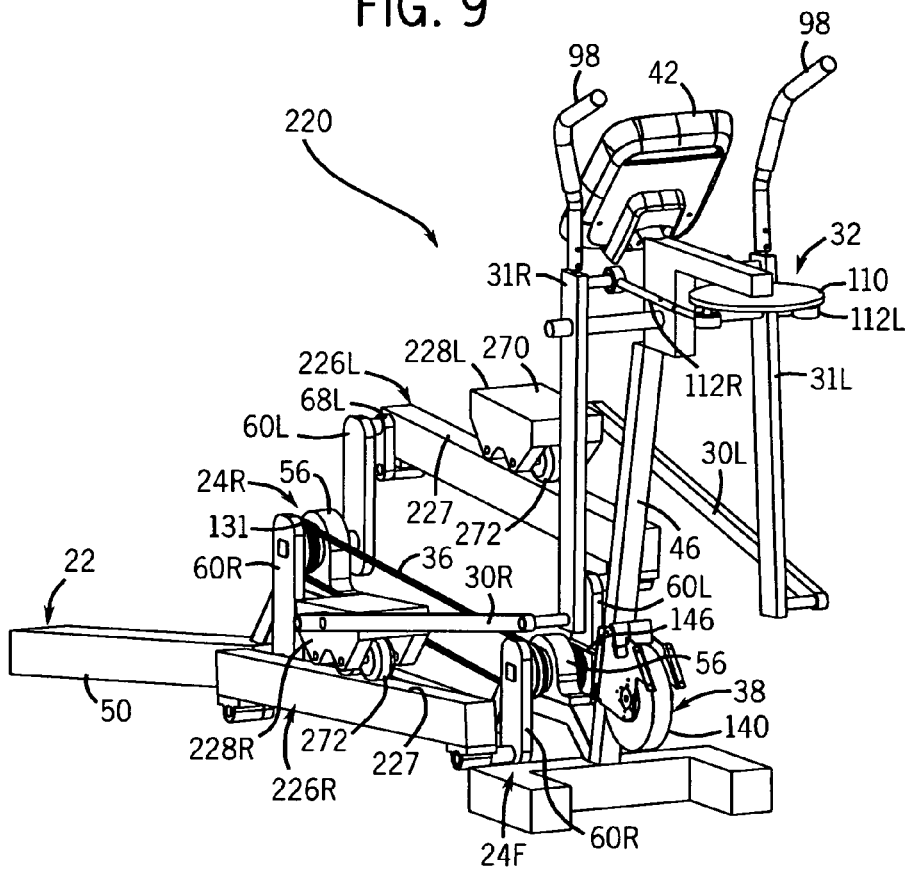
FIG. 9 is a front perspective view of another embodiment of the exercise device of FIG. 1 according to an example embodiment.
Figure 10:
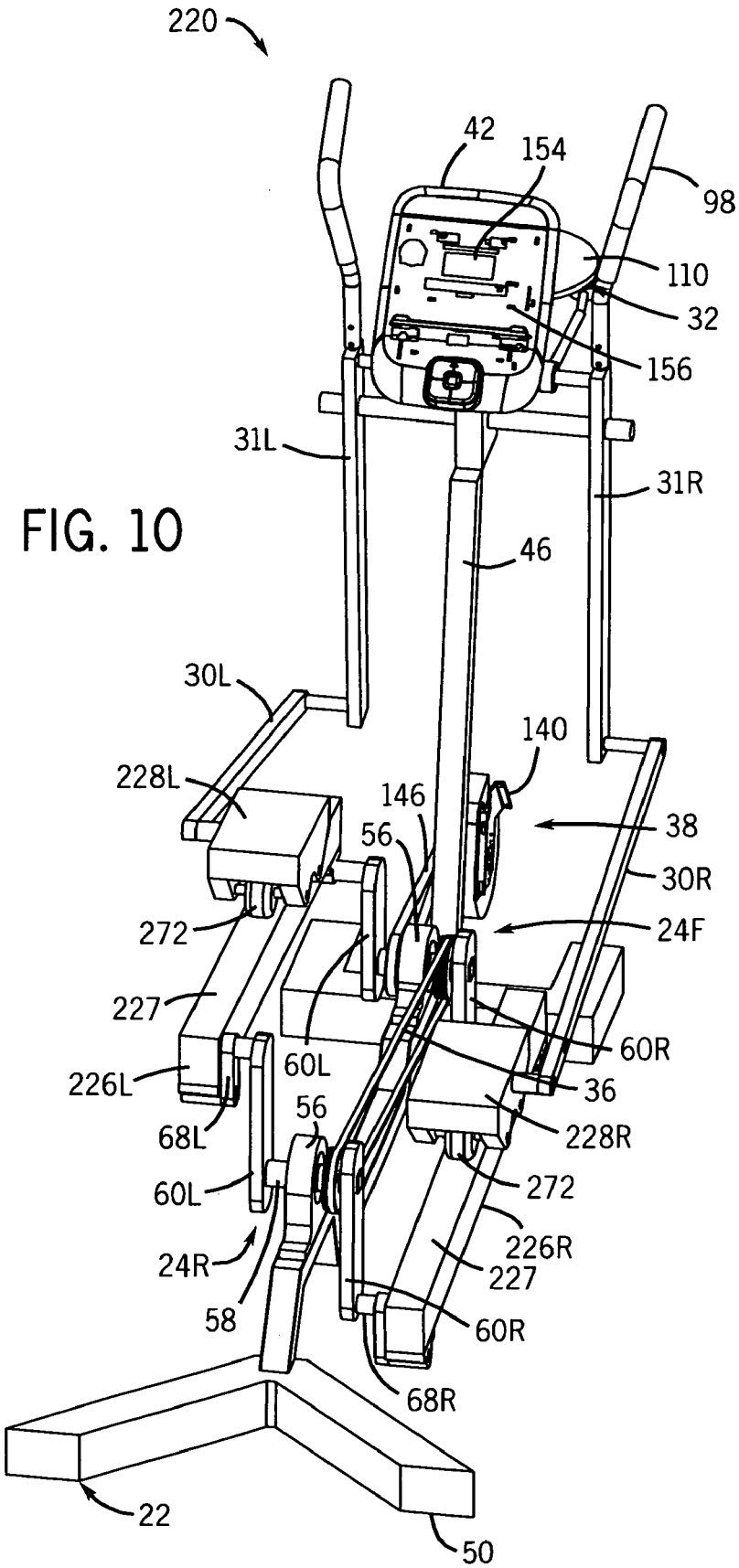
FIG. 10 is a rear perspective view of the exercise device of FIG. 9.
Figure 11:
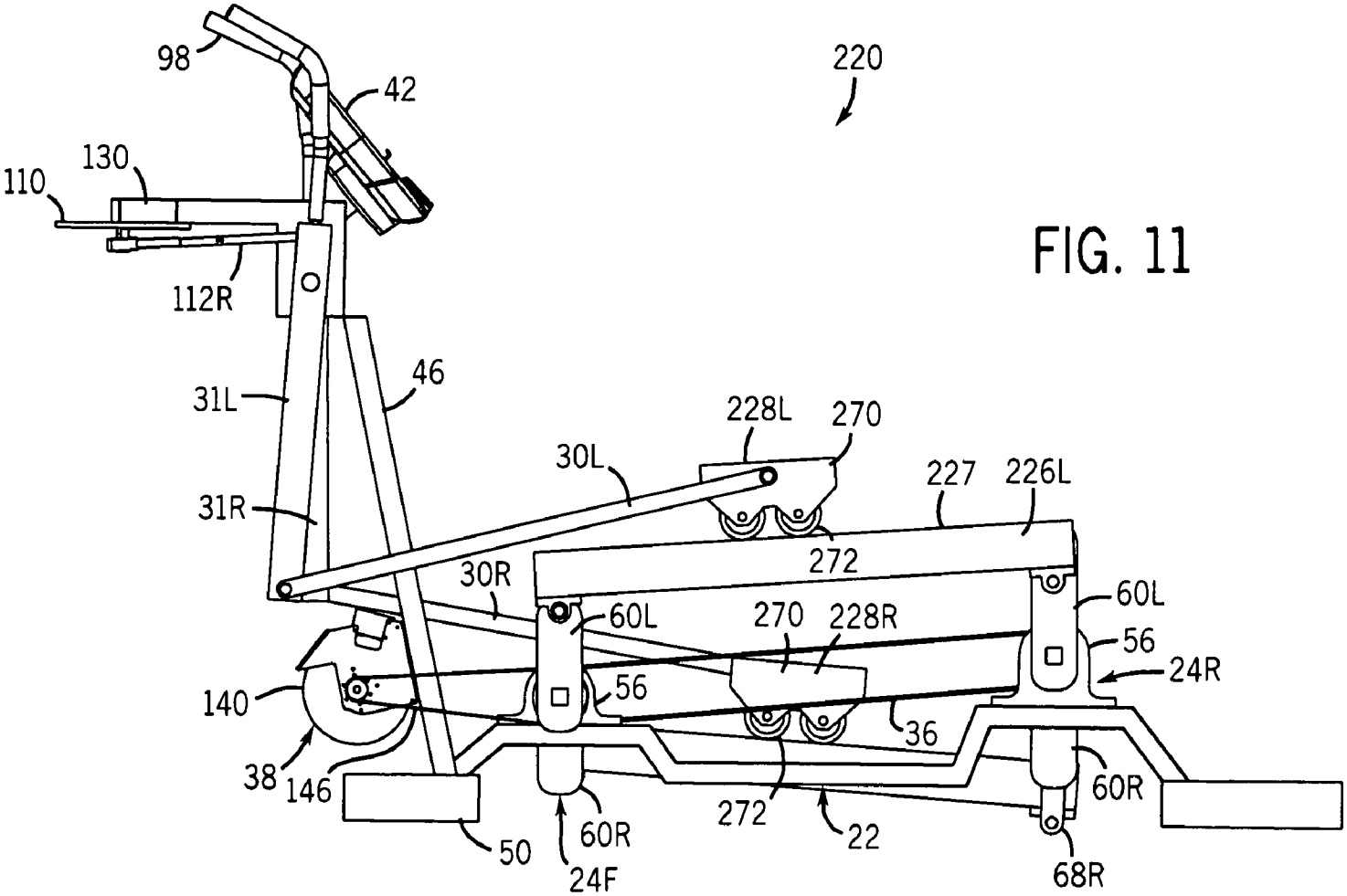
FIG. 11 is a left side elevational view of the exercise device of FIG. 9.
Figure 12:
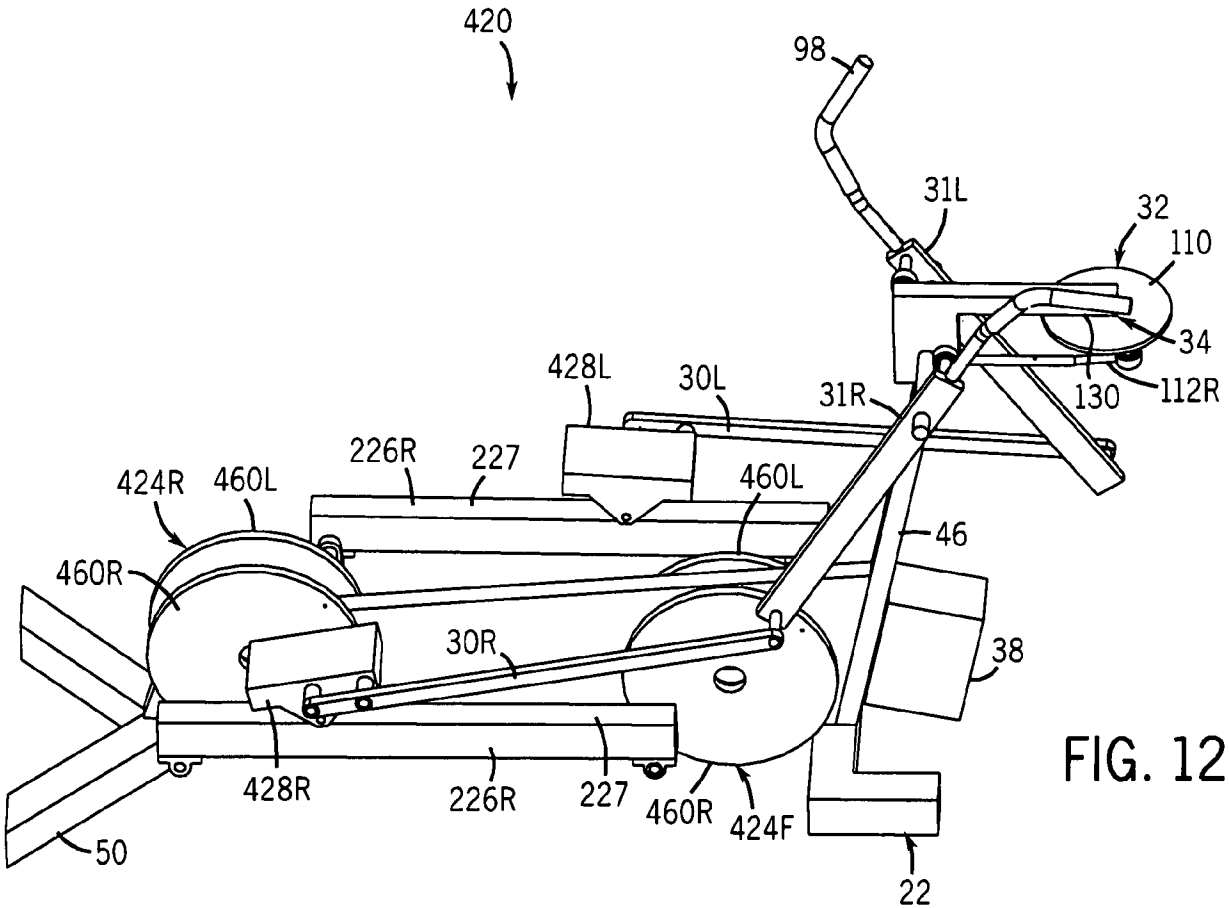
FIG. 12 is a perspective view of another embodiment of the exercise device of FIG. 1 according to an example embodiment.
Figure 13:
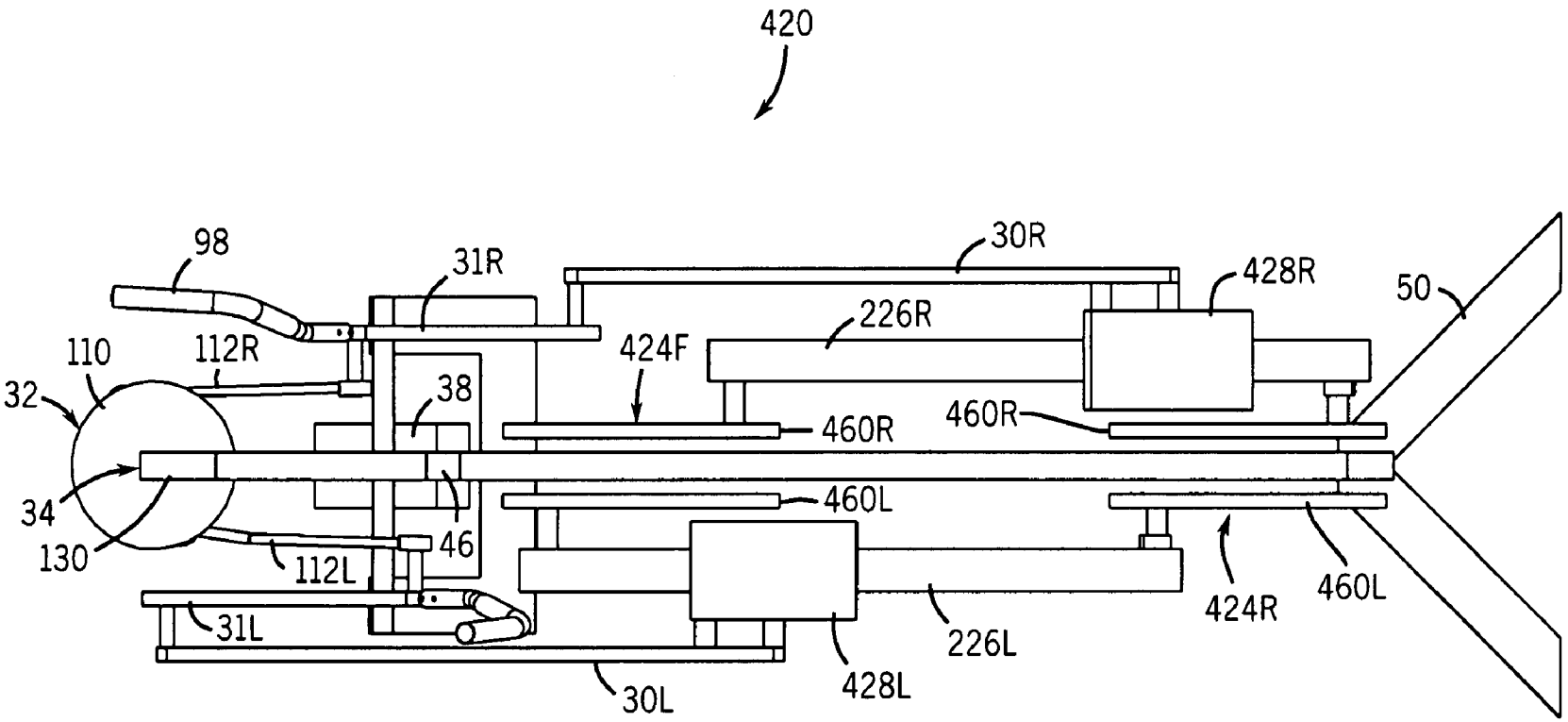
FIG. 13 is a top plan view of the exercise device of FIG. 12.
Figure 14:
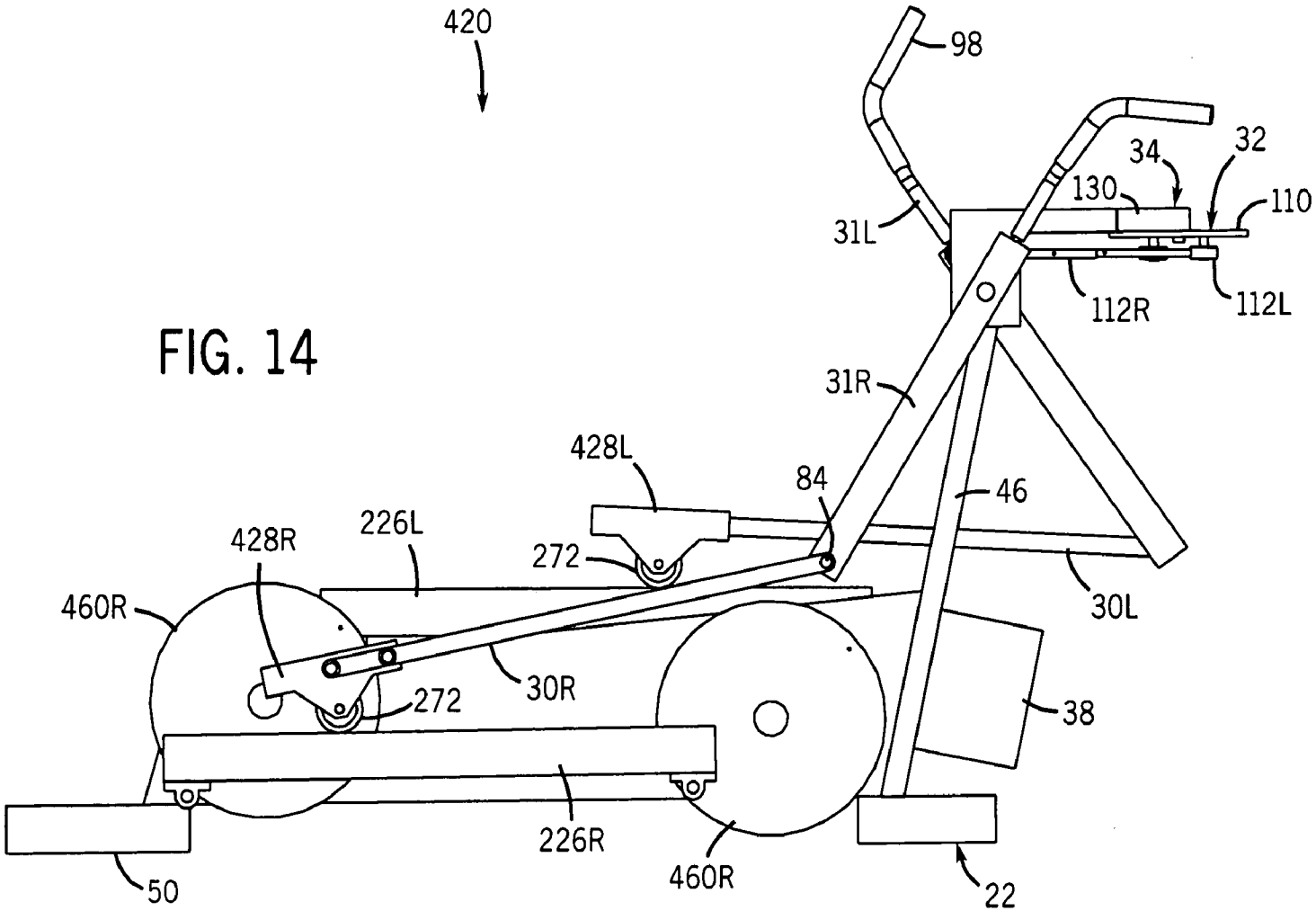
FIG. 14 is a side elevational view of the exercise device of FIG. 12.
Figure 15:
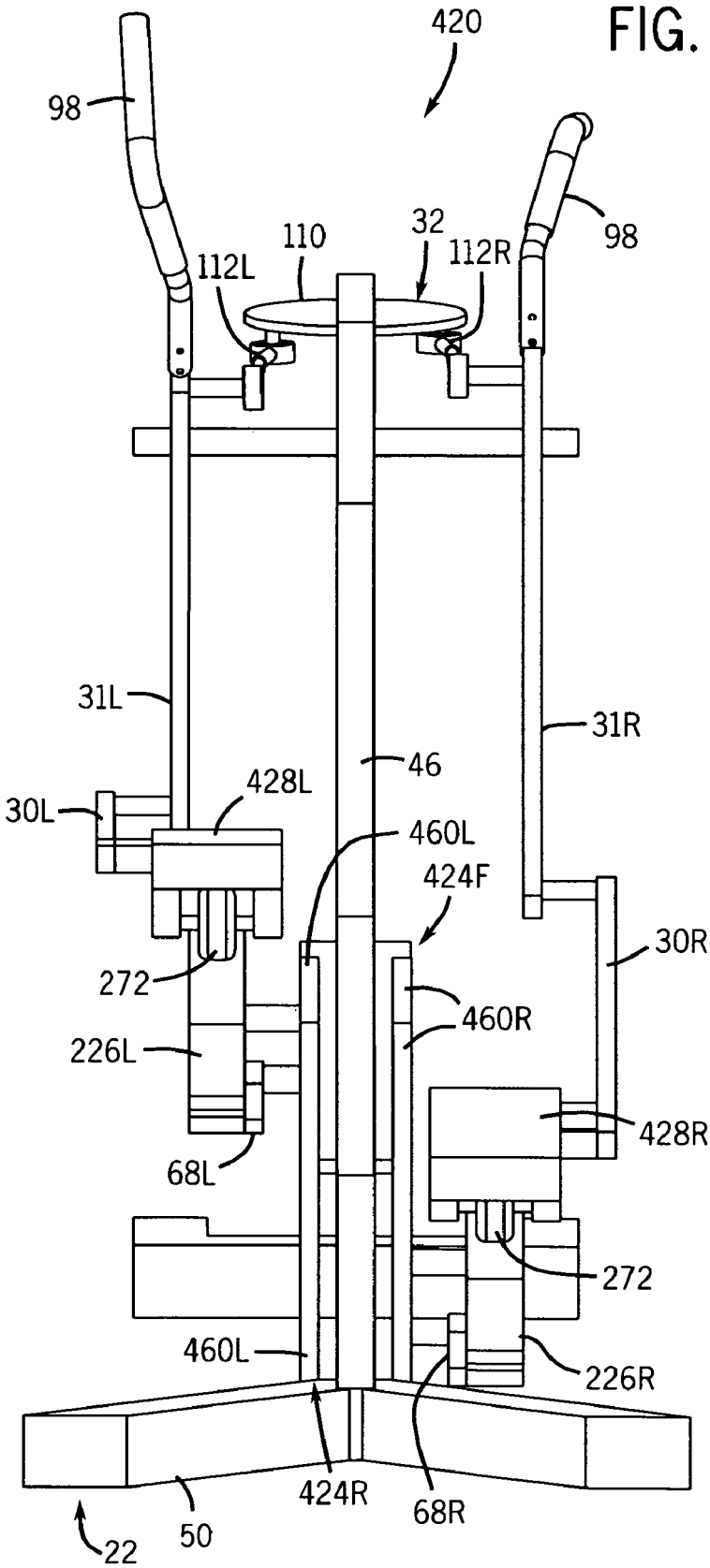
FIG. 15 is a rear elevational view of the exercise device of FIG. 12.

FIGS. 9-11 illustrate exercise device 220, another embodiment of exercise device 20. Exercise device 220 is similar to exercise device 20 except that exercise device to 220 includes guides 226L and 226R (collectively referred to as guides 226) and foot pads 270L and 270R (collectively referred to as foot pads 270) in place of guides 26 and foot pads 70. Those remaining elements of exercise device 220 which correspond to similar elements of exercise device 20 are numbered similarly.

Guides 226 comprise elongate structures configured to guide reciprocal movement of foot pad 28. In the example illustrated, each of guides 226 comprises a pair of ramps having surfaces 227 upon which foot pads 228 glide, slide or roll. Like each of guides 26, each of guides 226 has a first end portion 72 rotationally or pivotally connected to one of pivot links 68 of crank assembly 24R and a second end portion 74 rotationally or pivotally connected to portion 64 of one of crank arms 60 of crank assembly 24F. In the example illustrated in which crank arms 60 of crank assemblies 24R and 24F have substantially the same length (the same distance between a centerline of shaft 58 and the axis about which guide 26R, 26L pivots or rotates relative to the corresponding pivot link 68 of the crank arm 60 of crank assembly 24R or the axis about which guide 26 pivots or rotates relative to one of crank arm 60 of crank assembly 24F), guides 26 remains substantially horizontal or level while rotating about the axis of shafts 58 of crank assemblies 24R and 24F. In other embodiments where crank arms 60 of crank assembly 24R may have a different length as compared to crank arm 60 of crank assembly 24F, guides 26 may have inclined, declined or tilted orientations while rotating about the axes of shafts 58.

Foot pads 228, also known as pedals 228, comprise structures movably supported by guides 26 so as to reciprocate along guides 226. Foot pads 228 provide surfaces upon which a person's feet may rest and apply force. Foot pads 228 are further configured to pivot about at least one axis substantially perpendicular to the axis along which guides 226 extend. As a result, foot pad 228 provide for a more natural moving feel during motion. In other words, foot pads 228 pivot to adjust an angle at which a person's ankles bend during a stride for enhanced feel. In other embodiments in which guides 226 themselves tilt or pivot, such as when crank arms 60 of crank arm assembly 24R have different lengths as compared to crank arm 60 of crank assembly 24F, foot pads 228 may alternatively be pivotally fixed to guides 226 so as to not pivot or rotate as they travel along guides 226.

In the example illustrated, each of foot pads 228 includes a platform 270 and a pair of rollers 272. Platform 270 provides a surface upon which a person may place the bottom of his or her foot. Although not illustrated, in some embodiments, each foot pad 228 may be additionally provided with other structures for assisting in the retention of a person's foot upon foot pad 228 and for assisting a person in applying force to foot pad 228. For example, in other embodiments, each of platforms 270 may additionally include a toe clip or toe cup.

Rollers 272 comprise rollers rotationally coupled to platform 270 and configured to roll upon surfaces 227 of guides 226. In the example illustrated in which foot pads 270 each include two rollers rotating about different axes, platforms 270 are each pivotally connected to foot pad links 30. In other embodiments, foot pad 270 may include one or more rollers that rotate about a single axis and that support platforms 270 along guides 226. In such alternative embodiments, foot pad links 30 may alternatively be fixed to foot pads 270, wherein the single rotational axis of the one or more rollers also serves to pivot the associated foot pad platform 270 relative to surface 227 of the associated one of guides 226. In such embodiments, foot pad links 30 may alternatively remain pivotally connected to base or platform 270 of each of foot pads 228. In other embodiments, foot pads 228 may be movably coupled to guides 226 and may be pivotally supported in other fashions.

Like exercise device 20, exercise device 220 provides a person exercising with multiple user selectable paths of motion for foot pads 228. A particular path of motion for foot pads 228 may be adjusted by user by the user simply applying different forces or directional forces to foot pad 228 within his or her feet. Such changes in the motion paths may be made "on-the-fly" by the person excising during an exercise routine or workout without the person having to remove his or her hands from handgrips 98. Exercise devise automatically adapts to a person's motion or motion changes. Exercise device provides such freedom of motion with very few, if any, cantilevered members. For example, guides 226 which support foot pads 228 are supported at opposite ends have little, if any, cantilevered portions. Exercise device 220 provides a more solid and stable feel, may be formed from less structurally rigid materials and may be lighter in overall weight.

FIGS. 12-15 illustrate an exercise device 420, another embodiment of exercise device 20. Exercise device 420 is similar to exercise device 220 (shown in FIGS. 9-11) except that exercise device 420 includes crank assemblies 424R and 424F (collectively referred to as crank assemblies 424) and foot pads 428L and 428R (collectively referred to as foot pads 428) in place of crank assemblies 24R and 24F, respectfully. The remaining components of exercise device 420 which correspond to components of exercise device 220 are numbered similarly. For ease of illustration, some components of exercise device 420 are shown in FIGS. 8-9 with respect to exercise device 220 and are not shown in FIGS. 12-15. For example, in FIGS. 12-14, control panel 42 and vertical synchronizer 36 of exercise device four and 20 are not shown. Vertical resistance source 38 is schematically represented.

Like crank assemblies 24, crank assemblies 424 raise and lower guides 26 in response to force applied to such guides 26 through foot pad 28. Crank assemblies 424 allow person exercising to select an extent of vertical motion for an exercise path or routine. Crank assembly 424F is coupled to frame 22 proximate front 52 of exercise device 20 while crank assembly 424R is coupled to frame 22 proximate to rear end 53 of exercise device 420. As shown by FIGS. 12-15, crank assemblies 424 are similar to crank assemblies 24 except that crank assemblies 424 each include crank discs or crank wheels 460L and 460R (collectively referred to as crank wheels 460) in place of crank arms 60L and 60R, respectively. Like crank assembly 24R, crank assembly 424R also includes pivot links 68L and 68R (best seen in FIG. 15).

Foot pads 428 are similar to foot pads 28 except that foot pads 428 each include one or more rollers 472 that rotate about a single axis, enabling the axis of such rollers 472 to also serve as a pivot for the associated foot pad 428. As a result, in the example illustrated, each foot pad link 30 has an end portion 80 fixedly coupled to one of foot pads 428 at two points such that foot pad links 30 do not pivot relative to the pads 428. In other embodiments, foot pads 428 may alternatively include rollers 272 that rotate about two or more axes (such as with exercise device two and 20). In such alternative embodiments, foot pad links 30 are pivotally connected to foot pads 428.

Like exercise device 20, exercise device 420 provides a person exercising with multiple user selectable paths of motion for foot pads 428. A particular path of motion for foot pads 428 may be adjusted by user by the user simply applying different forces or directional forces to foot pad 428 within his or her feet. Such changes in the motion paths may be made "on-the-fly" by the person excising during an exercise routine or workout without the person having to remove his or her hands from handgrips 98. Exercise devise automatically adapts to a person's motion or motion changes. Exercise device provides such freedom of motion with very few, if any, cantilevered members. For example, guides 226 which support foot pads 428 are supported at opposite ends have little, if any, cantilevered portions. Exercise device 420 provides a more solid and stable feel, may be formed from less structurally rigid materials and may be lighter in overall weight.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise device comprising:

a frame;

a first crank assembly coupled to the frame;

a second crank assembly coupled to the frame;

a first guide having a first portion coupled to the first crank assembly so as to rotate with the first crank assembly and a second portion coupled to the second crank assembly so as to rotate with the second crank assembly;

a first foot pad coupled to the first guide to reciprocate along the first guide;

a first foot pad link having a first end portion connected to the first foot pad and a second end portion pivotably supported about a first axis that is movable along one of a first plurality of user selectable paths, each of the first plurality of user selectable paths having a different length, wherein a position of the first foot pad is configured to change between the first plurality of user selectable paths in response to force applied by a person to the first foot pad; and a second guide having a first portion coupled to the first crank assembly so as to rotate with the first crank assembly and a second portion coupled to the second crank assembly so as to rotate with the second crank assembly;

a second foot pad coupled to the second guide to reciprocate along the second guide;

a second foot pad link having a first end portion connected to the second foot pad and a second end portion pivotably supported about a second axis that is movable along one of a second plurality of user selectable paths, each of the second plurality of user selectable paths having a different length, wherein a position of the second foot pad is configured to change between the second plurality of user selectable paths in response to force applied by a person to the second foot pad;

wherein the first crank arm assembly further comprises a crank arm having a first portion rotationally coupled to the frame and a second portion rotationally coupled to the first guide; and a pivot link having a first end portion pivotably connected to the crank arm about a first link axis and a second end portion pivotably connected to the first portion of the first guide about a second link axis.

2. The exercise device of claim 1, wherein the first foot pad and the second foot pad are configured to reciprocate along the first guide and the second guide while the first axis and the second axis are stationary.

3. The exercise device of claim 2 wherein , as the first foot pad and the second foot pad reciprocate along the first guide and the second guide while the first axis and the second axis are stationary, the first foot pad and the second pad horizontally move in space by a first distance and vertically move in space by a second distance greater than the first distance.

4. The exercise device of claim 3, wherein the first foot pad is configured to reciprocate along the first guide while the first axis is moving along a first one of the first plurality of paths having a first distance and is configured to reciprocate along the first guide while the first axis is moving along a second one of the first plurality of paths having a second distance different than the first distance.

5. The exercise device of claim 1, wherein one of the first plurality of paths and wherein one of the second plurality of paths has a length of zero.

6. The exercise device of claim 1, wherein the first axis is configured to be changed from a first one of the first plurality of paths to a second one of the first plurality of paths without changing rotation of the first crank arm assembly and the second crank arm assembly relative to the frame.

7. The exercise device of claim 1, wherein the second portion of the first guide is directly pivotably connected to the second crank arm assembly without an intervening pivot link.

8. The exercise device of claim 1 further comprising handgrips at a front end of the exercise device, wherein the second crank arm assembly is disposed between the front-end and the first crank arm assembly.

9. The exercise device of claim 1, wherein the second crank arm assembly comprises a second crank arm having a first portion rotationally coupled to the frame and a second portion rotationally coupled to the first guide.

10. The exercise device of claim 1, wherein the first foot pad is configured to pivot relative to the first guide.

11. The exercise device of claim 10, wherein the first guide comprises at least one rail and wherein the first foot pad is configured to slide along the rail.

12. The exercise device of claim 1 further comprising:

a first arm having a first end portion pivotably coupled to the first foot pad link at the first axis, a second end portion having a handgrip and an intermediate portion pivotably connected to the frame; and a second arm having a first end portion pivotably coupled to the second foot pad link at the second axis, a second end portion having a handgrip and an intermediate portion pivotably connected to the frame.

13. The exercise device of claim 12 further comprising:

a first synchronization mechanism configured to synchronize movement of the first axis and the second axis such that the first axis moves 180 degrees out of phase with respect to movement of the second axis; and a second synchronization mechanism configured to synchronize vertical movement of the guides and their associated foot pads.

14. The exercise device of claim 12 further comprising a first user adjustable resistance source operably coupled to the first arm and the second arm to resist horizontal movement of the first foot pad and the second foot pad.

15. The exercise device of claim 14 further comprising a second user adjustable resistance source operably coupled to at least one of the first crank arm assembly and the second crank arm assembly to resist vertical movement of the first foot pad and the second foot pad.

16. The exercise device of claim 1 further comprising a synchronization mechanism configured to synchronize movement of the first axis and the second axis such that the first axis moves substantially 180 degrees out of phase with respect to movement of the second axis.

17. The exercise device of claim 1, wherein the first portion of the first guide is pivotably connected to the first crank arm assembly at a first location radially spaced from a rotational axis of the first crank arm assembly by a first distance and wherein the second portion of the first guide is pivotably connected to the second crank arm assembly at a second location radially spaced from a rotational axis of the second crank arm assembly by a second distance greater than the first distance.

18. The exercise device of claim 1 further comprising a vertical height actuator configured to selectively raise and lower a rotational axis of the first crank arm assembly relative to a rotational axis of the second crank arm assembly.

19. An exercise device comprising:

a frame;

a first crank assembly coupled to the frame;

a second crank assembly coupled to the frame;

a first guide having a first portion coupled to the first crank assembly so as to rotate with the first crank assembly and a second portion coupled to the second crank assembly so as to rotate with the second crank assembly;

a first foot pad coupled to the first guide to reciprocate along the first guide;

a first foot pad link having a first end portion connected to the first foot pad and a second end portion pivotably supported about a first axis that is movable along one of a first plurality of user selectable paths, each of the first plurality of user selectable paths having a different length, wherein a position of the first foot pad is configured to change between the first plurality of user selectable paths in response to force applied by a person to the first foot pad, wherein the first foot pad is configured to pivot relative to the first guide, wherein the first guide comprises at least one rail and wherein the first foot pad is configured to slide along the rail; and a second guide having a first portion coupled to the first crank assembly so as to rotate with the first crank assembly and a second portion coupled to the second crank assembly so as to rotate with the second crank assembly;

a second foot pad coupled to the second guide to reciprocate along the second guide;

a second foot pad link having a first end portion connected to the second foot pad and a second end portion pivotably supported about a second axis that is movable along one of a second plurality of user selectable paths, each of the second plurality of user selectable paths having a different length, wherein a position of the second foot pad is configured to change between the second plurality of user selectable paths in response to force applied by a person to the second foot pad.

20. An exercise device comprising:

a frame;

a first crank assembly coupled to the frame;

a second crank assembly coupled to the frame;

a first guide having a first portion coupled to the first crank assembly so as to rotate with the first crank assembly and a second portion coupled to the second crank assembly so as to rotate with the second crank assembly;

a first foot pad coupled to the first guide to reciprocate along the first guide;

a first foot pad link having a first end portion connected to the first foot pad and a second end portion pivotably supported about a first axis that is movable along one of a first plurality of user selectable paths, each of the first plurality of user selectable paths having a different length, wherein a position of the first foot pad is configured to change between the first plurality of user selectable paths in response to force applied by a person to the first foot pad; and a second guide having a first portion coupled to the first crank assembly so as to rotate with the first crank assembly and a second portion coupled to the second crank assembly so as to rotate with the second crank assembly;

a second foot pad coupled to the second guide to reciprocate along the second guide;

a second foot pad link having a first end portion connected to the second foot pad and a second end portion pivotably supported about a second axis that is movable along one of a second plurality of user selectable paths, each of the second plurality of user selectable paths having a different length, wherein a position of the second foot pad is configured to change between the second plurality of user selectable paths in response to force applied by a person to the second foot pad;

a first arm having a first end portion pivotably coupled to the first foot pad link at the first axis, a second end portion having a handgrip and an intermediate portion pivotably connected to the frame;

a second arm having a first end portion pivotably coupled to the second foot pad link at the second axis, a second end portion having a handgrip and an intermediate portion pivotably connected to the frame;

a first synchronization mechanism configured to synchronize movement of the first axis and the second axis such that the first axis moves 180 degrees out of phase with respect to movement of the second axis; and a second synchronization mechanism configured to synchronize pivoting of the first arm and the second arm such that the first arm moves substantially 180 degrees out of phase with respect to movement of the second arm; and a first user adjustable resistance source operably coupled to the first arm and the second arm to resist horizontal movement of the first foot pad and the second foot pad.

21. An exercise device comprising:

a frame;

a first crank assembly coupled to the frame;

a second crank assembly coupled to the frame;

a first guide having a first portion coupled to the first crank assembly so as to rotate with the first crank assembly and a second portion coupled to the second crank assembly so as to rotate with the second crank assembly;

a first foot pad coupled to the first guide to reciprocate along the first guide;

a first foot pad link having a first end portion connected to the first foot pad and a second end portion pivotably supported about a first axis that is movable along one of a first plurality of user selectable paths, each of the first plurality of user selectable paths having a different length, wherein a position of the first foot pad is configured to change between the first plurality of user selectable paths in response to force applied by a person to the first foot pad, wherein the first portion of the first guide is pivotably connected to the first crank arm assembly at a first location radially spaced from a rotational axis of the first crank arm assembly by a first distance and wherein the second portion of the first guide is pivotably connected to the second crank aim assembly at a second location radially spaced from a rotational axis of the second crank arm assembly by a second distance greater than the first distance; and a second guide having a first portion coupled to the first crank assembly so as to rotate with the first crank assembly and a second portion coupled to the second crank assembly so as to rotate with the second crank assembly;

a second foot pad coupled to the second guide to reciprocate along the second guide;

a second foot pad link having a first end portion connected to the second foot pad and a second end portion pivotably supported about a second axis that is movable along one of a second plurality of user selectable paths, each of the second plurality of user selectable paths having a different length, wherein a position of the second foot pad is configured to change between the second plurality of user selectable paths in response to force applied by a person to the second foot pad.

22. An exercise device comprising:

a frame;

a first crank assembly coupled to the frame;

a second crank assembly coupled to the frame;

a first guide having a first portion coupled to the first crank assembly so as to rotate with the first crank assembly and a second portion coupled to the second crank assembly so as to rotate with the second crank assembly;

a first foot pad coupled to the first guide to reciprocate along the first guide;

a first foot pad having a first end portion connected to the first foot pad and a second end portion pivotably supported about a first axis that is movable along one of a first plurality of user selectable paths , each of the first plurality of user selectable paths having a different length, wherein a position of the first foot pad is configured to change between the first plurality of user selectable path in response to force applied by a person to the first foot pad; and a second guide having a first portion coupled to the first crank assembly so as to rotate with the first crank assembly and a second portion coupled to the second crank assembly so as to rotate with the second crank assembly;

a second foot pad coupled to the second guide to reciprocate along the second guide;

a second foot pad link having a first end portion pivotably connected to the second foot pad and a second end portion pivotably supported about a second axis that is movable along one of a second plurality of user selectable paths, each of the second plurality of user selectable paths having a different length, wherein a position of the second foot pad is configured to change between the second plurality of user selectable paths in response to force applied by a person to the second foot pad; and a vertical height actuator configured to selectively raise and lower a rotational axis of the second crank arm assembly relative to a rotational axis of the first crank arm assembly.

* * * * *